US007380794B2

(12) United States Patent
Noyes

(10) Patent No.: US 7,380,794 B2
(45) Date of Patent: Jun. 3, 2008

(54) MODIFIED METHOD OF PLAYING BLACKJACK

(76) Inventor: Frederick D. Noyes, 688 Bar Harbor Rd., Trenton, ME (US) 04605

( * ) Notice: Subject to any disclaimer, the term of this patent is extended or adjusted under 35 U.S.C. 154(b) by 353 days.

(21) Appl. No.: 10/817,727

(22) Filed: Apr. 2, 2004

(65) Prior Publication Data

US 2005/0023758 A1 Feb. 3, 2005

Related U.S. Application Data

(60) Provisional application No. 60/460,527, filed on Apr. 4, 2003.

(51) Int. Cl.
*A63F 1/00* (2006.01)

(52) U.S. Cl. ..... 273/292; 273/274

(58) Field of Classification Search ..... 273/274, 273/292, 293, 303, 309; 463/15, 12
See application file for complete search history.

(56) References Cited

U.S. PATENT DOCUMENTS 5,174,579 A * 12/1992 Griffiths ..... 273/292
5,288,081 A 2/1994 Breeding
5,364,105 A * 11/1994 Jones ..... 273/292
5,390,934 A * 2/1995 Grassa ..... 273/292
5,413,353 A * 5/1995 Demarest et al. ..... 273/292
5,423,551 A * 6/1995 Stavinsky ..... 273/306
5,454,570 A * 10/1995 Karal ..... 273/292
5,540,444 A * 7/1996 Nguyen ..... 273/292
5,577,731 A * 11/1996 Jones ..... 273/292
5,673,917 A * 10/1997 Vancura ..... 273/292
5,743,532 A * 4/1998 Lafferty ..... 273/292
5,791,989 A * 8/1998 Slinkman ..... 463/12
6,000,699 A * 12/1999 Long ..... 273/292
6,158,741 A * 12/2000 Koelling ..... 273/292
6,279,910 B1 * 8/2001 de Keller ..... 273/292
6,293,864 B1 * 9/2001 Romero ..... 463/12
6,336,859 B2 * 1/2002 Jones et al. ..... 463/13
6,481,718 B2 * 11/2002 Koelling ..... 273/292
6,536,769 B1 * 3/2003 Palacios et al. ..... 273/292
6,676,128 B2 * 1/2004 Wolf ..... 273/292
6,719,291 B1 * 4/2004 deKeller ..... 273/274
6,808,173 B2 * 10/2004 Snow ..... 273/292
2003/0222400 A1 * 12/2003 Collins et al. ..... 273/274

* cited by examiner

*Primary Examiner*—Benjamin Layno
(74) *Attorney, Agent, or Firm*—Preti Flaherty Beliveau & Pachios LLP

(57) ABSTRACT

A method of playing a modified version of blackjack between participants including a dealer and one or more players. The method includes the steps of each player placing a first wager to participate in a standard blackjack game against the dealer, and each player and the dealer placing a side wager into a side wager pot. The dealer then deals a two-card hand to each player and a two-card hand to the dealer and each hand is played out according to standard methods of playing blackjack. The method further includes awarding the side wager pot to the participant, if any, having a final hand count that is higher than all other final hand counts without exceeding twenty-one.

9 Claims, 1 Drawing Sheet

MODIFIED METHOD OF PLAYING BLACKJACK

CROSS REFERENCES TO RELATED APPLICATIONS

This application claims the benefit of U.S. Provisional Application No. 60/460,527, filed Apr. 4, 2003.

BACKGROUND OF THE INVENTION

This invention relates generally to card games and more particularly to a modified version of blackjack that involves some or all of the players placing an additional wager at the beginning of a hand.

Blackjack (also known as twenty-one) is a common playing card game in which one or more players play against a dealer. The players play individually against the dealer, not against one another. Each player's objective is to hold a hand of two or more cards having a count closer to 21 (without going over) than the count of the dealer's hand. In determining the count of a hand, cards numbered 2-9 are assigned a rank equal to their respective face value, 10's, jacks, queens, and kings are assigned a rank of 10, and aces are assigned a rank of 1 or 11, at the player's option.

Blackjack is often played in casinos where each player places a wager on the outcome of a hand against the house. Wagers are placed at the beginning of the hand, before any cards are dealt. Play then begins with the dealer dealing two cards to each player and himself. Each player then is given the opportunity to "hit" (take an additional card) in an attempt to achieve a count closer to 21. The player can elect to "stand" (decline to take more cards) at anytime if satisfied with his or her count or concerned that another card will result in a "bust" (i.e., a count exceeding 21). Players can also exercise certain options such as "doubling down," "splitting pairs," and "surrender" in given situations. After all of the players have elected to stand on their hand, the dealer plays out his or her hand based on pre-established rules for the game. Typically, if the dealer has less than 17, the dealer must take a hit. If the dealer has 17 or more, the dealer stands.

A player wins the wager against the house if his or her count is closer to 21 than the dealer's count; the player loses the wager if the dealer's count is closer to 21 than that player's count. Any player that busts loses regardless of the final count of the dealer's hand. If a player's and the dealer's counts are the same (without exceeding 21), no one wins and the hand is called a "push." Any player receiving a "blackjack" (i.e., a two-card hand having a count of 21, also referred to as a natural) wins at once, unless the dealer is also dealt a blackjack. Blackjacks are typically paid off at one and a half times the wager.

While conventional blackjack is considered by many to be an exciting game, all players play against the dealer only and not among themselves. Furthermore, there is only one wagering opportunity during the course of each deal. Thus, if a player busts early in a hand and thus loses automatically, he or she has no further interest in that deal and must wait idly while the other players and the dealer play out their hands. Accordingly, it would be desirable to have a modified version of blackjack in which players could play among themselves as well as against the dealer and place additional wagers that could maintain interest in a deal after a player's hand has played out.

SUMMARY OF THE INVENTION

The above-mentioned need is met by the present invention, which provides a method of playing a card game based on the standard blackjack game but played with an added twist that involves some or all of the players at a blackjack table joining in placing an additional bet or a side wager in an attempt to beat every other player at the table and the dealer. This option of placing an additional bet in anticipation of having the "highest" hand at the table adds the excitement of having an opportunity to win a much larger "pot" as well as bringing friendly competitiveness to the table. Pots that are "pushed" will grow rapidly and even a player that loses his or her hand against the dealer can still be involved in the next deal of the game.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
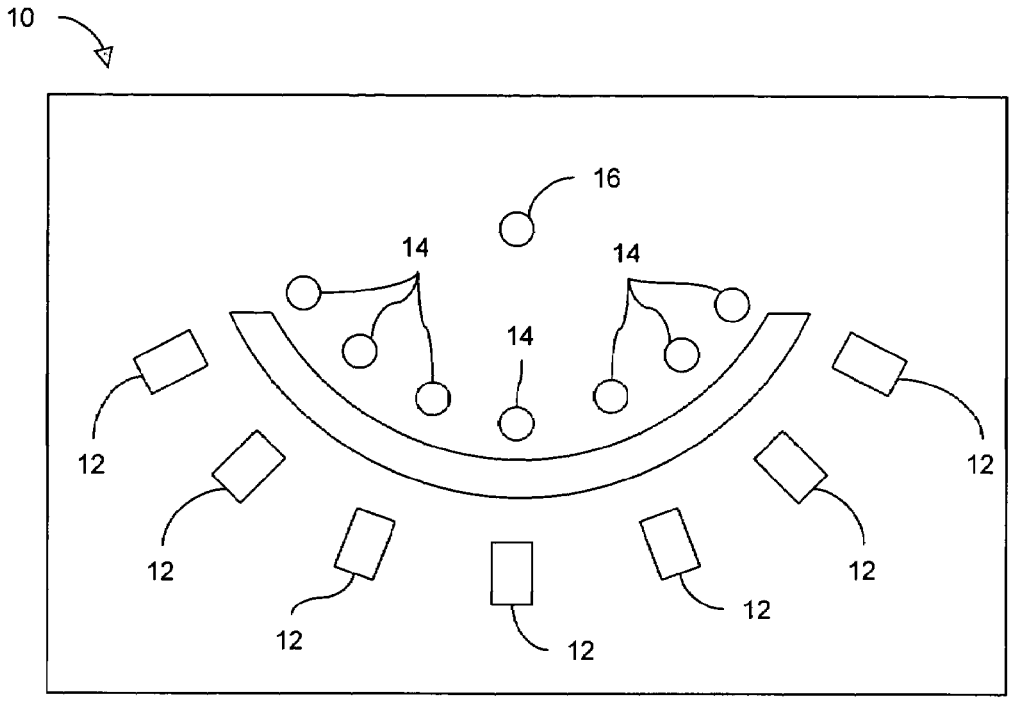
FIG. 1 shows a gaming table based on a traditional blackjack table and having additional features that facilitate playing the game of the present invention.

In one embodiment of the present invention, play begins with each player placing a wager on the outcome of his or her hand against the dealer, just as is done in conventional blackjack. The amount of this wager is at the player's option, limited only by any house limits that may be in effect. Each player, at his or her option, can also place an additional or side wager of a pre-determined amount for each table ($5 for this example, but any amount could be used), by presenting the dealer a betting chip that the dealer places on a designated spot in front of the dealer which corresponds to the player's seat at the table. As shown in FIG. 1, a table 10 is provided with a layout that has seven player positions, by way of example. The table layout includes a betting square 12 for each player position that receives the player's blackjack wager. The table layout may have an additional circle spot 14 for each table seat, for receiving the player's side wager, as well as another circle spot 16 which will receive the dealer's side wager. It should be noted that the shapes of the betting squares 12 and the circle spots 14, 16 are not limiting as these features can take other shapes. An alternative method of displaying and/or handling the player's side wager in the present invention is to have a special "chip display" or jackpot container located in front of the dealer that holds all bets associated with the side wager.

Figure 2:
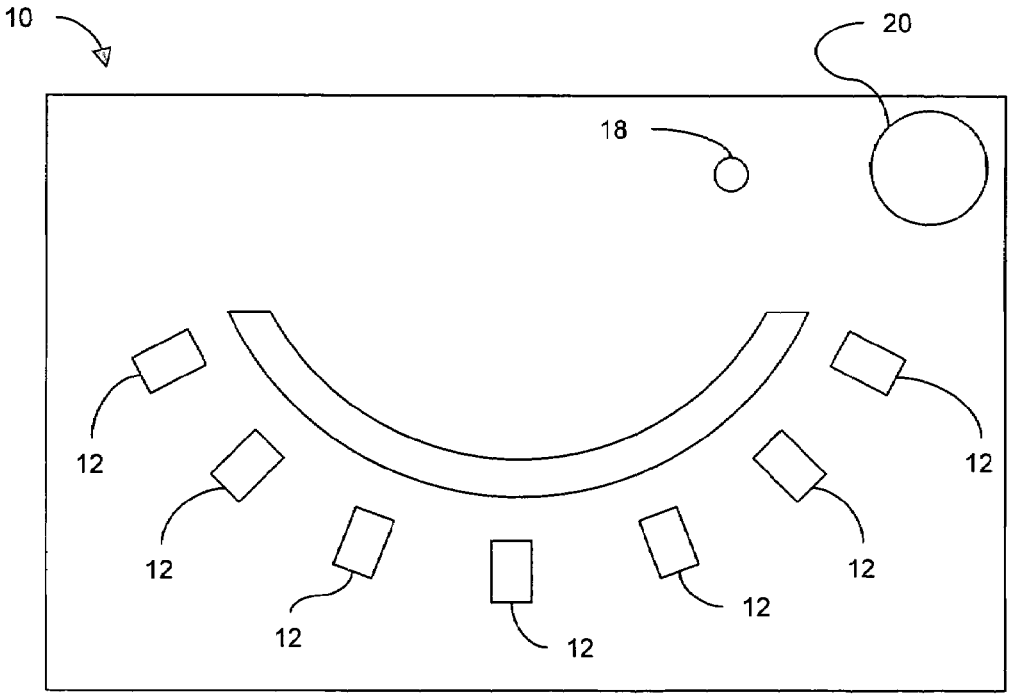
FIG. 2 shows another version of a gaming table that can be used to play the game of the present invention.

All wagers are placed at the beginning of the hand, before any cards are dealt. Thus, after the conventional blackjack wagers have been placed and before a hand is dealt, the players at the table 10 are asked if they would like to compete in the side wager. Those that respond positively will give the dealer a $5 chip to be placed on his or her related circle spot 14. The dealer will then place a $5 chip from the casino chip rack on the dealer's circle spot 16. Any player that does not place a $5 wager before a hand of cards is dealt is declared ineligible for that round of the side wager and cannot participate in the side wagering until the beginning of another round. Before the dealer deals the first of perhaps several hands of the game, a two-sided "puck" is placed before the circle spots discussed above to indicate that a round of side wagering is in progress and no new players may participate in the ongoing side wagering round until a winner is declared (similar to the roll-out "number" at craps). In this embodiment, the side wager aspect of the game of the present invention is optional. Thus, the game can accommodate players who wish to play conventional blackjack only, while allowing other players to partake in the side wagering. Alternatively, a table 10 can be designated as being dedicated to the side wagering, in which case all players at the table are required to participate in the side wagering. In this case, a single puck 18 can be used to indicate that a round of side wagering is in progress, as shown in FIG. 2. FIG. 2 also shows a jackpot container 20 used to hold the side wagers instead of the player and dealer circle spots.

Once all wagers have been made, play proceeds in normal blackjack fashion with each player and the dealer being dealt two cards. After the initial deal, each hand is played out with respect to the conventional blackjack wager and paid off as usual. That is, each player "hits" and/or "stands" to achieve a count as close to 21 as possible without busting. Players can also exercise certain options such as "doubling down," "splitting pairs," and "surrender" in given situations. After all of the players have elected to stand on their hand, the dealer plays out his or her hand based on pre-established rules for the game.

With respect to the side wager pot, the goal of the participating players and the dealer is to have the highest final hand count at the table for that deal. Before all the completed hands are removed from the table the dealer will determine which position at the table, including the dealer's, had the highest count without busting. Should a player or the dealer stand alone with the highest hand count without busting, they shall be declared the winner and receive all the monies on all the special circle spots or in the jackpot container (i.e., the entire side wager pot). At this point the puck shall be turned over indicating a new round of side wagering is beginning.

If, as will be the case in many instances, there are two or more hands at the table that are tied with the highest count, including the dealer's, a "push" is declared, meaning that the side wager pot is not awarded and all players participating in the side wager must place an additional $5 chip before the dealer to be placed on his or her appropriate circle spot to continue competing for the side wager pot. (If a player elects to not put in an additional chip, then he or she will no longer compete for the side wager pot and forfeits all money previously put into the current side wager pot.) The dealer must also place another $5 chip in the designated dealer circle spot, after which another hand of cards is dealt. Hands are continued in this fashion until the side wager pot is awarded, at which point a new round of side wagering can start.

Whenever a player participating in the side wager chooses to double down or split pairs he or she will be required to present another chip ($5 in this example) to the dealer to be placed on his or her designated circle spot. Every new hand that develops because of doubling down or splitting pairs will require an additional $5 payment to the side wager jackpot for the round of play. In the case of a player splitting pairs and receiving the highest hand count at the table with both hands, that player will win the side wager pot. In other words, a player that has split pairs cannot push himself.

The dealer plays along with the players in the side wager and must compete with their results head on. However, whenever the dealer alone receives a "blackjack" (i.e., a two-card hand count of twenty-one) the round of side wagering is automatically over with the dealer declared the winner of the side wager pot, even if one or more of the players receives a hand count of twenty-one with three or more cards. This automatic win for the dealer via a blackjack represents the casino vigorish for the side wager. An alternative approach to providing the casino vigorish for the side wager is to give the dealer/casino a predetermined percentage (such as 5 percent) of each side wager pot.

Other than the dealer automatically winning when he is the only one to receive a blackjack all other winning hands are decided on the card counts, even if one or more players has a blackjack. In other words, a player blackjack is treated as a hand count of 21 and will result in a "push" in the side wager if just one other player or the dealer has a resulting hand count of 21.

The present invention provides a variation of blackjack that can be played in many environments. As described above, the game is played live in casinos with a dealer. However, the game can also be played live by two or more people in non-casino environments such as a home. The game can also be played from a variety of locations in interactive electronic or video form. In addition to being played live with actually playing cards, the game can be played electronically via video game machines, home computers and the like.

While specific embodiments of the present invention have been described, it will be apparent to those skilled in the art that various modifications thereto can be made without departing from the spirit and scope of the invention as defined in the appended claims.

What is claimed is:

1. A method of playing a modified version of blackjack between participants including a dealer and one or more players, said method comprising:

each player placing a first wager to participate in a standard blackjack game against the dealer;

each player and the dealer placing a side wager into a side wager pot;

the dealer dealing a two-card hand to each player and a two-card hand to the dealer;

the dealer and each player playing out the hands according to the standard method of playing blackjack;

if only one participant has a final hand count that is higher than all other final hand counts without exceeding twenty-one, awarding the side wager pot to that participant and not awarding the side wager pot to any participant if two or more participants have a final hand count that is higher than all other final hand counts without exceeding twenty-one; and subsequent to not awarding the side wager pot to any participant because two or more participants have a final hand count that is higher than all other final hand counts without exceeding twenty-one, the dealer and each player electing to continue to compete for the side wager pot places another side wager into the side wager pot, whereafter subsequent hands are played out according to the standard method of playing blackjack and if only one participant has a final hand count that is higher than all other final hand counts without exceeding twenty-one, the side wager pot is awarded to that participant.

2. The method of claim 1 wherein the amount of the first wager is at each player's option.

3. The method of claim 1 wherein the amount of the side wager is a predetermined amount.

4. The method of claim 1 wherein no new players are permitted to participate in an ongoing round of side wagering.

5. The method of claim 4 further comprising using a puck to indicate that a round of side wagering is in progress.

6. The method of claim 1 wherein when only the dealer receives a two-card hand having a hand count of twenty-one, the dealer is awarded the side wager pot.

7. The method of claim 1 wherein a predetermined percentage of each side wager pot is given to the dealer.

8. The method of claim 1 wherein additional players can participate in a standard blackjack game with the dealer while not competing for the side wager pot.

9. A method of playing a modified version of blackjack between participants including a dealer and one or more players, said method comprising:

each player placing a first wager to participate in a standard blackjack game against the dealer;

each player and the dealer placing a side wager into a side wager pot;

the dealer dealing a two-card hand to each player and a two-card hand to the dealer;

the dealer and each player playing out the hands according to the standard method of playing blackjack;

if only the dealer receives a two-card hand having a hand count of twenty-one, awarding the side wager pot to the dealer;

if only one participant has a final hand count of twenty-one, awarding the side wager pot to that participant and not awarding the side wager pot to any participant if two or more participants have a final hand count of twenty-one; and subsequent to not awarding the side wager pot to any participant because two or more participants have a final hand count of twenty-one, the dealer and each player electing to continue to compete for the side wager pot places another side wager into the side wager pot, whereafter subsequent hands are played out according to the standard method of playing blackjack and if only the dealer receives a two-card hand having a hand count of twenty-one, awarding the side wager pot to the dealer and if only one participant has a final hand count of twenty-one, awarding the side wager pot to that participant.

* * * * *